US007124597B2

(12) United States Patent
Kattner et al.

(10) Patent No.: US 7,124,597 B2
(45) Date of Patent: Oct. 24, 2006

(54) BRACKISH GROUND WATER COOLING SYSTEMS AND METHODS

(75) Inventors: John Francis Kattner, Minneapolis, MN (US); Scott Jason Blumeyer, Lake Bluff, IL (US)

(73) Assignee: Cooling Networks LLC, Minneapolis, MN (US)

( * ) Notice: Subject to any disclaimer, the term of this patent is extended or adjusted under 35 U.S.C. 154(b) by 31 days.

(21) Appl. No.: 11/049,612

(22) Filed: Feb. 2, 2005

(65) Prior Publication Data

US 2006/0168979 A1 Aug. 3, 2006

(51) Int. Cl.
*F25D 23/12* (2006.01)

(52) U.S. Cl. ..... 62/260

(58) Field of Classification Search ..... 62/260, 62/324; 165/45; 137/363
See application file for complete search history.

(56) References Cited

U.S. PATENT DOCUMENTS 4,270,522 A * 6/1981 Vandenberg ..... 126/594
5,320,166 A 6/1994 Swenson
5,440,894 A 8/1995 Schaeffer et al.
6,041,613 A 3/2000 Morse et al.
6,244,219 B1 * 6/2001 Krum ..... 119/245
6,481,232 B1 11/2002 Faqih
6,688,129 B1 2/2004 Ace

OTHER PUBLICATIONS

"Seawater System Proposed to Cool Medical School", HonoluluAdvertiser.com, http://the.honoluluadvertiser.com/article/2004/Feb/02/In/In07a.html/?print-on, 3 pages (last printed Feb. 2, 2004).

* cited by examiner

*Primary Examiner*—Melvin Jones
(74) *Attorney, Agent, or Firm*—Merchant & Gould P.C.

(57) ABSTRACT

The invention includes systems and methods for using brackish ground water for air conditioning. In an embodiment, the present invention includes a method of using brackish water to provide cooling in an energy efficient and environmentally friendly manner. By way of example, the invention includes a method for providing cooling with brackish water including drawing brackish water from a supply well, transferring heat to the brackish water, and then returning the brackish water to the ground through a return well to a depth where the ground is already at a temperature similar to that of the now-heat brackish water that is being returned. In an embodiment, the present invention includes a cooling system that uses brackish water. By way of example, the invention includes a cooling system having a brackish water loop, a condenser water loop in thermal communication with the brackish water loop, and a chilled water loop in thermal communication with the condenser water loop.

18 Claims, 4 Drawing Sheets

BRACKISH GROUND WATER COOLING SYSTEMS AND METHODS

FIELD OF THE INVENTION

The invention relates to cooling systems. More specifically, the invention relates to cooling systems and methods using brackish ground water.

BACKGROUND OF THE INVENTION

Many air-cooling systems for commercial size buildings employ the use of evaporation towers in order to dissipate heat removed during the cooling process. However, these systems consume a substantial amount of fresh-water that is lost during the evaporation process. Also, these systems consume substantial amounts of energy. As such, other techniques have been employed to provide cooling for enclosed spaces.

Many systems draw fresh-water from aquifers and use this water as a heat sink to dissipate heat removed during the cooling process. However, the fresh-water used in these systems may result in a burden on the local fresh water supply. Further, environmental concerns place constraints on how this water can be disposed of after it is used. Finally, not all locales have sufficient quantities of fresh-water that can be dedicated for use in cooling systems. Accordingly, a need exists for an energy efficient cooling system that preserves existing fresh-water supplies.

SUMMARY OF THE INVENTION

The invention includes systems and methods for using brackish ground water resources for air conditioning. In an embodiment, the present invention includes a method of using brackish water to provide cooling in an energy efficient and environmentally friendly manner. By way of example, the invention includes a method for providing cooling with brackish water including drawing brackish water from a supply well, transferring heat to the brackish water, and then returning the brackish water to the ground through a return well to a depth where the temperature is relatively close to the temperature of the returned brackish water. By returning the heated brackish water to a depth where the temperature is already relatively close to that of the returned brackish water, it is believed that the environmental impact can be minimized. In addition, by using brackish water, fresh water can be conserved.

In an embodiment, the present invention includes a ground water based cooling system that uses brackish water. By way of example, the invention includes a cooling system having a brackish water loop, a condenser water loop in thermal communication with the brackish water loop, and a chilled water loop in thermal communication with the condenser water loop. The brackish water loop can include a supply well adapted and configured to draw brackish water from the ground, a brackish water conduit, adapted and configured to hold and transfer brackish water, in fluid communication with the supply well, and a return well adapted and configured to return brackish water to the ground, the return well returning water to a depth wherein the temperature is within two degrees of the brackish water being returned. The condenser water loop can include a condenser water conduit adapted and configured to hold and transfer a fluid and a condenser. The chilled water loop can include a chilled water conduit adapted and configured to hold a fluid, an evaporator, and cooling coils.

DETAILED DESCRIPTION OF THE INVENTION

Brackish water refers to water that has a higher dissolved salt content than fresh water. As used herein, the term brackish water shall refer to water having an amount of dissolved salts greater than 0.5 grams per liter. The term brackish water can also encompass salt water. Brackish water can be found in many areas, such as coastal and desert areas, at temperatures that make it a suitable candidate for use as a heat sink. However, brackish water can be extremely corrosive toward metals making its use in existing cooling systems more difficult. Further, brackish water is more difficult to dispose of in an environmentally friendly way. Specifically, brackish water may not be able to be simply discharged into convenient areas, such as a drainage ditch, without creating potential environmental problems.

In an embodiment, the present invention includes a method of using brackish water to provide cooling in an energy efficient and environmentally friendly manner. By way of example, the invention includes a method for providing cooling with brackish water including drawing brackish water from a supply well, transferring heat to the brackish water, and then returning the brackish water to the ground through a return well to a depth where the ground is already at a temperature and/or chemical make-up similar to that of the now-heat brackish water that is being returned. While not intending to be bound by theory, it is believed that returning the heated brackish water to a depth where the temperature and/or chemistry is already close to that of the returned water can minimize the environmental impact. In addition, by using brackish water, supplies of fresh water can be conserved.

In an embodiment, the present invention includes a ground water based cooling system that uses brackish water in an energy efficient and environmentally friendly manner. By way of example, the invention includes a cooling system having a brackish water loop, a condenser water loop in thermal communication with the brackish water loop, and a chilled water loop in thermal communication with the condenser water loop. The brackish water loop can include a supply well adapted and configured to draw brackish water from the ground, a brackish water conduit, adapted and configured to hold and transfer brackish water, in fluid communication with the supply well, and a return well adapted and configured to return brackish water to the ground, the return well returning water to a depth wherein the temperature is relatively close to that of the brackish water being returned. The condenser water loop can include a condenser water conduit adapted and configured to hold and transfer a fluid and a condenser. The chilled water loop can include a chilled water conduit adapted and configured to hold a fluid, an evaporator, and cooling coils. Embodiments of the invention will now be described in greater detail.

Figure 1:
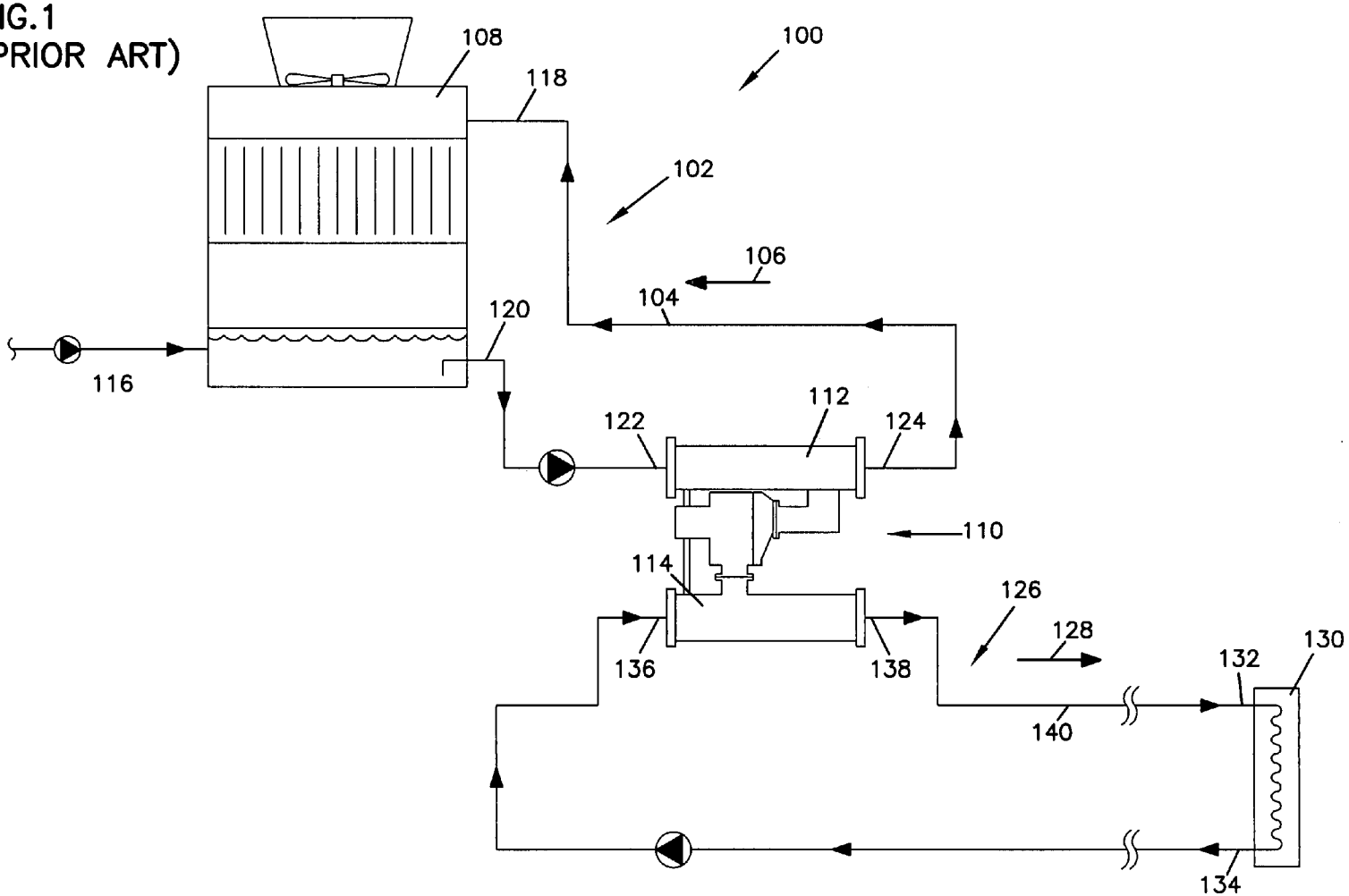
FIG. 1 (PRIOR ART)
FIG. 1 is a schematic view of a typical cooling system for commercial applications.

Referring to FIG. 1, a schematic view of a typical cooling system 100 for commercial applications is shown. The system 100 includes a condenser water loop 102 in thermal communication with a chilled water loop 126. A mechanical chiller 110 includes a condenser 112 and an evaporator 114 and provides thermal communication between the condenser water loop 102 and the chilled water loop 126. The condenser water loop 102 includes a conduit 104 through which fresh water flows in the direction of arrow 106. The water absorbs heat energy in the condenser 112 and flows through the conduit 104 to a cooling tower 108. By way of example, the temperature of the water when it enters 122 the condenser 112 may be about 85 degrees F. The temperature of the water when it exits 124 the condenser 112 may be about 95 degrees F. Similarly, the temperature of the water when it enters 118 the cooling tower 108 may be about 95 degrees F. Through the evaporative cooling process, the evaporative cooling tower 108 removes heat energy from the fresh water. By way of example only, the temperature of the fresh water when it exits 120 the cooling tower 108 may be about 85 degrees F. Because water is lost during the evaporative cooling process in the cooling tower 108, additional fresh water (make-up water) must be pumped into the system through a supply conduit 116.

The chilled water loop 126 includes a conduit 140 through which water flows in the direction of arrow 128. The water exits the evaporator 114 and travels to the cooling coils 130. By way of example only, the water temperature may be about 42 degrees F. when it leaves 138 the evaporator 114 and when it enters 132 the cooling coils 130. The water absorbs heat energy when it passes through the cooling coils 130. The now-heated water travels through the conduit 140 and enters the evaporator 136. By way of example, the temperature of the water when it leaves 134 the cooling coils 130 and when it enters 136 the evaporator may be about 56 degrees F. Accordingly, the system 100 shown in FIG. 1 removes heat energy from commercial enclosures but uses a significant amount of fresh water in the cooling tower 108 and uses a significant amount of energy in the mechanical chiller 110.

Figure 2:
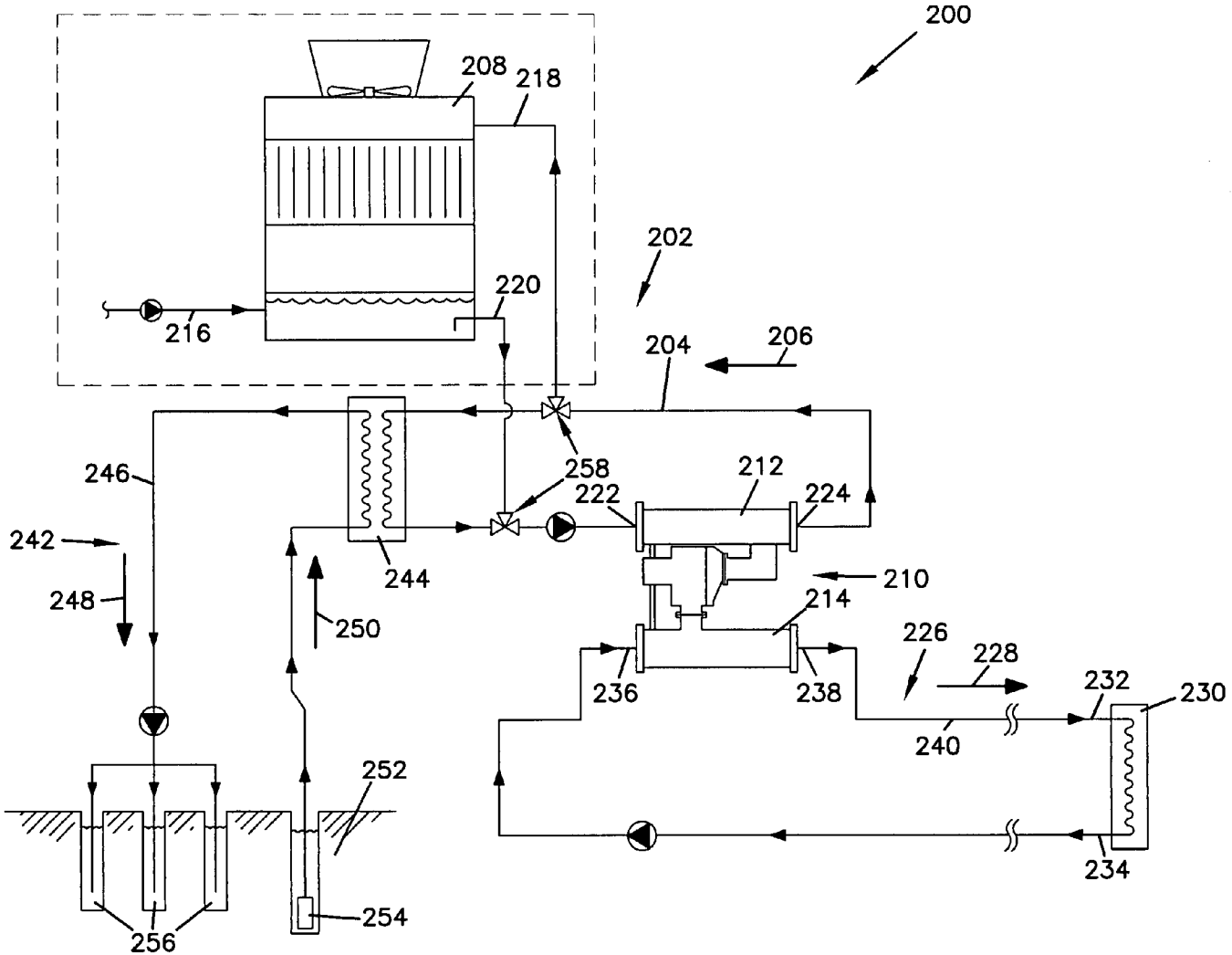
FIG. 2 is a schematic view of a cooling system in accordance with an embodiment of the invention.

Referring now to FIG. 2, a schematic view of a cooling system 200 in accordance with an embodiment of the invention is shown. The system 200 includes a brackish water loop 242 in thermal communication with a condenser water loop 202, which in turn is in thermal communication with a chilled water loop 226. The brackish water loop 242 includes a production or supply well 254 which draws brackish water up from the ground 252. One of skill in the art will appreciate that more than one supply well can also be used depending on the volumes of brackish water needed for the system. In an embodiment, the brackish water that enters the system is approximately 53 degrees F. However, one of skill in the art will appreciate that the brackish water may be a variety of temperatures when it first enters the system. The brackish water moves through a brackish water conduit 246 in the direction of arrows 250 and 248. In an embodiment, the brackish water conduit 246 comprises a corrosion resistant material. By way of example, the brackish water conduit may comprise a corrosion resistant metal, a polymer, or a composite material.

The brackish water passes through a heat exchanger 244 in which it absorbs heat energy from the condenser water loop 202. In an embodiment, the brackish water enters the heat exchanger 244 at approximately 53 degrees F. and exits at approximately 71 degrees F. As described above, these temperatures are only examples and different specific temperatures can be used depending on the system design. Heat exchanger 244 can be either a tubular or non-tubular type heat exchanger. As an example, the heat exchanger 244 can be a plate-and-frame type heat exchanger. In an embodiment, the heat exchanger can be a gasketed-plate exchanger or a welded-plate heat exchanger. Many different types of heat exchanges are known in the art and can be used. See Shilling et al., Heat Transfer Equipment, Perry's Chemical Engineers' Handbook $7^{th}$ Ed. § 11 (McGraw-Hill 1997). In an embodiment, components of the heat exchangers 244 include titanium. However, one of skill in the art will appreciate that other materials that are resistant to the corrosive effects of brackish water can also be used.

After the brackish water absorbs heat from the condenser water loop 202, it continues flowing through the brackish water conduit 246 and into one or more injection or return wells 256. The brackish water then seeps into the ground from the return wells 256. In an embodiment, the return wells 256 can be pressurized to increase the speed with which the brackish water seeps into the ground. In areas where the temperature of the ground varies with the depth, the return wells 256 can be drilled to various depths such that the temperature of the brackish water being returned is relatively close to the temperature of the ground at the depth of the return wells 256. In an embodiment, the temperature of the ground at the depth of the return wells 256 is within about 25 degrees F. of the temperature of the brackish water being returned. The temperature of the ground at the depth of the return wells 256 can also be within about 15 degrees F. of the temperature of the brackish water being returned. In a particular embodiment, the temperature of the ground at the depth of the return wells 256 is within about 5 degrees F. of the temperature of the brackish water being returned. As a further example, the temperature of the ground at the depth of the return wells 256 can be from about 50 degrees F. to about 76 degrees F.

In an embodiment, the temperature of the ground at the depth of the return well(s) 256 is at least 5 degrees F. different than the temperature of the ground at the depth of the supply well(s) 254. In a specific embodiment, the temperature of the ground at the depth of the return well(s) 256 is at least 10 degrees F. different than the temperature of the ground at the depth of the supply well(s) 254. In an embodiment, the temperature of the ground at the depth of the return well(s) 256 is at least 15 degrees F. different than the temperature of the ground at the depth of the supply well(s) 254.

While not intending to be bound by theory, it is believed that the environmental impact of a brackish water cooling system can be minimized by returning brackish water to a depth where the ground is of approximately the same temperature as the water. By way of example, thermal pollution of the ground at the depth of the return wells can be minimized by returning brackish water to a depth where the temperature is similar to that of the brackish water being returned. Specifically, it is believed that returning brackish water to a depth matching its temperature will reduce the chances that the returned water will seep through the ground and into neighboring fresh-water aquifers, either vertically or horizontally proximal. In addition, it is believed that this technique can reduce the potential for inadvertently mobilizing potential contaminants that may exist in the ground. Finally, it is believed that that this technique can minimize the impact on the geochemical stability of the ground in the proximity of the return wells.

The condenser water loop 202 includes a conduit 204 through which a fluid flows in the direction of arrow 206. In an embodiment, the fluid is non-brackish water. A mechanical chiller 210 includes a condenser 212 and an evaporator 214 and provides thermal communication between the condenser water loop 202 and the chilled water loop 226. The condenser water absorbs heat energy in the condenser 212 and flows through the conduit 204 to the heat exchanger 244. By way of example, the temperature of the water when it enters 222 the condenser 212 may be about 56 degrees F. The temperature of the water when it exits 224 the condenser 212 may be about 73 degrees F. However, the precise temperature of the water at different points in the system of FIG. 2 can be varied according to the system design. While a mechanical chiller including a condenser and an evaporator is shown in FIG. 2, one of skill in the art will appreciate that many different types of heat pumps can function to transfer heat energy from the chilled water loop 226 to the condenser water loop 202, and are within the scope of the invention described herein. For example many different types of heat pumps are described in Shilling et al., Heat Transfer Equipment, Perry's Chemical Engineers' Handbook $7^{th}$ Ed. § 11 (McGraw-Hill 1997) and are within the scope of the invention.

Optionally, a cooling tower 208 may be incorporated into the condenser water loop 202. The cooling tower 208 can be included as an emergency back-up device to dissipate heat energy from the system 200. The flow of water to the cooling tower 208 can be controlled though valves 258. Through the evaporative cooling process, the evaporative cooling tower 208 removes heat energy from the water in circumstances where the brackish water loop 242 may not be able to remove enough heat energy. By way of example, the temperature of the water when it exits 220 the cooling tower 208 may be about 85 degrees F. However, when cooling tower 208 is operational, some fresh water is lost during the evaporative cooling process and additional water (make-up water) must be pumped into the system through a freshwater supply conduit 216.

The chilled water loop 226 includes a conduit 240 through which a fluid flows in the direction of arrow 228. In an embodiment, the fluid is non-brackish water. The water exits the evaporator 214 and travels to the cooling coils 230. By way of example, the water temperature may be about 42 degrees F. when it leaves 238 the evaporator 214 and when it enters 232 the cooling coils 230. However, as described above, the precise temperature of the water at different points in the system of FIG. 2 can be varied according to the system design. The water absorbs heat energy when it passes through the cooling coils 230. The now-heated water travels through the conduit 240 and enters the evaporator 214. By way of example, the temperature of the water when it leaves 234 the cooling coils 230 may be about 56 degrees F. The evaporator further removes heat energy from the water in the chilled water loop.

Figure 3:
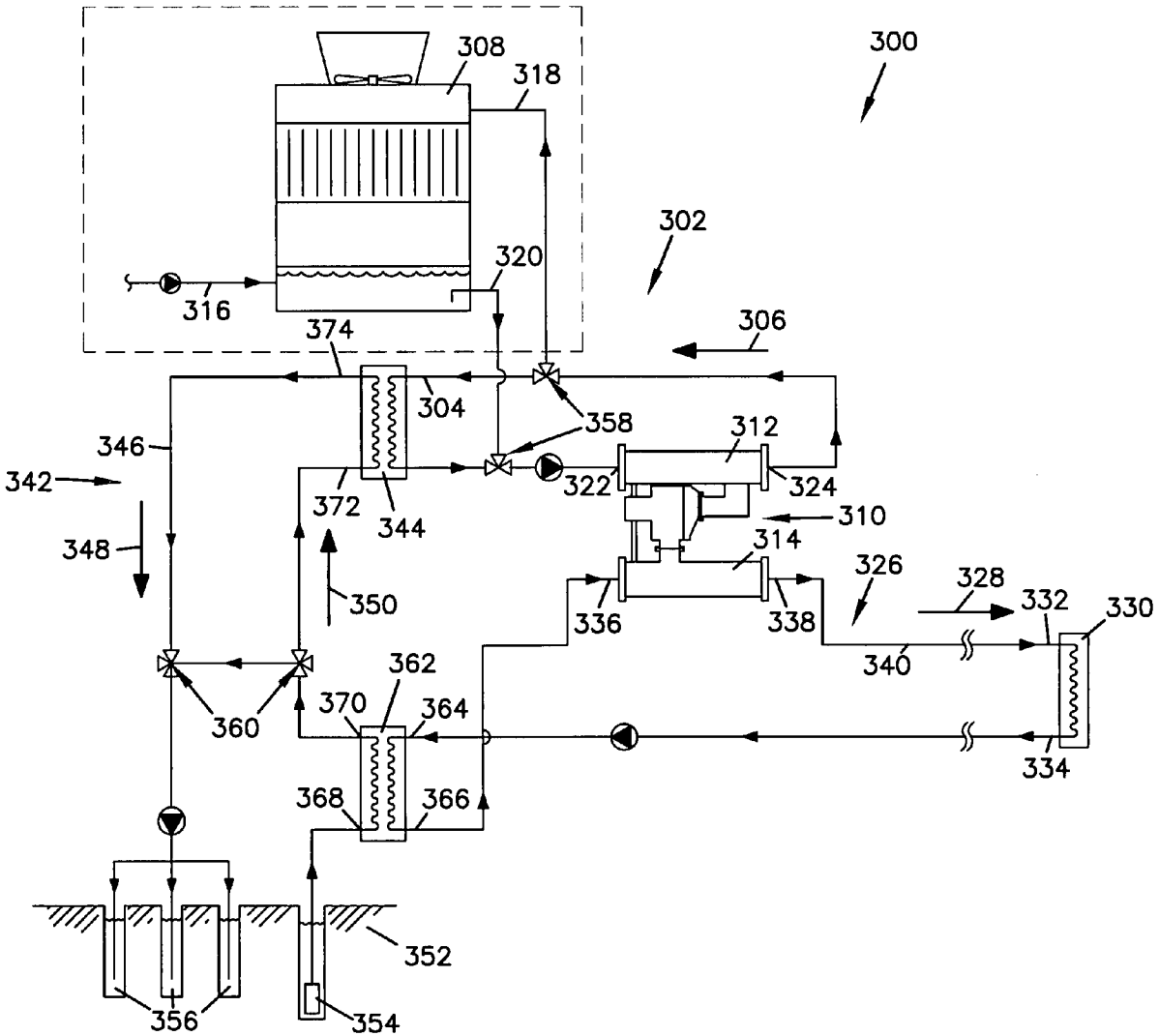
FIG. 3 is a schematic view of a cooling system in accordance with another embodiment of the invention.

Referring now to FIG. 3, a schematic view of a cooling system 300 in accordance with another embodiment of the invention is shown. The system 300 includes a brackish water loop 342 in thermal communication with a condenser water loop 302, which in turn is in thermal communication with a chilled water loop 326. The brackish water loop 342 includes a production or supply well 354 which draws brackish water up from the ground 352. One of skill in the art will appreciate that more than one supply well can also be used depending on the volumes of brackish water needed for the system. In an embodiment, the brackish water that enters the system is approximately 47 degrees F. However, this temperature is only provided as an example. The precise temperature of the water at different points in the system of FIG. 3 can be varied according to the system design. The water moves through a brackish water conduit 346 in the direction of arrows 350 and 348. The brackish water passes through a first heat exchanger 362 in which it absorbs heat energy from the chilled water loop 326. In an embodiment, the brackish water enters the first heat exchanger 362 at approximately 47 degrees F. and exits at approximately 54 degrees F. The brackish water then moves through the conduit 346 to a second heat exchanger 344 in which it absorbs heat energy from the condenser water loop 302. Optionally, however, valves 360 may be operated such that the brackish water returns directly to the return wells 356. In an embodiment, after the brackish water absorbs heat energy from the condenser water loop 302 it is heated up to approximately 71 degrees F. Again, as stated above, this temperature is provided merely as an example and can be varied. As an example, the heat exchangers 362 and 344 can be plate-and-frame type heat exchangers. In an embodiment, the heat exchangers can be gasketed-plate exchangers or welded-plate heat exchangers. Many different types of heat exchangers are known in the art and can be used. See Shilling et al., Heat Transfer Equipment, Perry's Chemical Engineers' Handbook $7^{th}$ Ed. § 11 (McGraw-Hill 1997). In an embodiment, components of the heat exchangers 362, 344 include titanium. However, one of skill in the art will appreciate that other materials that are resistant to the corrosive effects of brackish water can also be used.

After the brackish water absorbs heat from the condenser water loop 302, it continues flowing through the brackish water conduit 346 and into one or more injection or return wells 356. The brackish water then seeps into the ground from the return wells 356. In areas where the temperature of the ground varies with the depth, the return wells 356 can be drilled to various depths such that the temperature of the brackish water being returned matches the temperature of the ground at the depth of the return wells 356. In an embodiment, the temperature of the ground at the depth of the return wells 356 is within about 25 degrees F. of the temperature of the brackish water being returned. In an embodiment, the temperature of the ground at the depth of the return wells 356 is from about 50 degrees F. to about 76 degrees F.

The condenser water loop 302 includes a conduit 304 through which a fluid flows in the direction of arrow 306. In an embodiment, the fluid is non-brackish water. A mechanical chiller 310 includes a condenser 312 and an evaporator 314 and provides thermal communication between the condenser water loop 302 and the chilled water loop 326. The condenser water absorbs heat energy in the condenser 312 and flows through the conduit 304 to the second heat exchanger 344. By way of example, the temperature of the water when it enters 322 the condenser 312 may be about 56 degrees F. The temperature of the water when it exits 324 the condenser 312 may be about 73 degrees F. Similarly, the temperature of the water when it enters the second heat exchanger 344 may be about 73 degrees F. These temperatures are provided merely as an example and can be varied. While a mechanical chiller including a condenser and an evaporator is shown in FIG. 3, one of skill in the art will appreciate that many different types of heat pumps can function to transfer heat energy from the chilled water loop 326 to the condenser water loop 302 and are within the scope of the invention described herein.

Optionally, a cooling tower 308 may be incorporated into the condenser water loop 302. The cooling tower 308 can be included as an emergency back-up device to dissipate heat energy from the system 300. The flow of water to the cooling tower 308 can be controlled though valves 358. Through the evaporative cooling process, the evaporative cooling tower 308 removes heat energy from the water in circumstances where the brackish water loop 342 may not be able to remove enough heat energy on its own. By way of example, the temperature of the water when it exits 320 the cooling tower 308 may be about 85 degrees F. However, when cooling tower 308 is operational, some fresh water is lost during the evaporative cooling process and additional water (make-up water) must be pumped into the system through a fresh-water supply conduit 316.

The chilled water loop 326 includes a conduit 340 through which a fluid flows in the direction of arrow 328. In an embodiment, the fluid is non-brackish water. The water exits the evaporator 314 and travels to the cooling coils 330. By way of example, the water temperature may be about 42 degrees F. when it leaves 338 the evaporator 314 and when it enters 332 the cooling coils 330. The water absorbs heat energy when it passes through the cooling coils 330. The now-heated water travels through the conduit 340 and enters the first heat exchanger 362. By way of example, the temperature of the water when it leaves 334 the cooling coils 330 and when it enters 366 the first heat exchanger 362 may be about 56 degrees F. Heat energy is removed from the water as it passes through the first heat exchanger 362. In an embodiment, the temperature of the water as it leaves the first heat exchanger 362 is about 49 degrees F. Again, these specific temperatures are provided merely as examples. One of skill in the art will appreciate that the temperatures can be varied. The water then travels through the conduit 340 and enters the evaporator 314. The evaporator further removes heat energy from the water in the chilled water loop.

In the systems described above, it is assumed that the chilled water is approximately 42 degrees F. when it enters the cooling coils 230, 330. However, it will be appreciated that cooling coils could be designed to function with incoming water of a different temperature. If the cooling systems described were used with cooling coils designed to handle water of a different temperature than 42 degrees F., then the specifics of other temperatures described within the system could change accordingly. While specific temperatures were described for the water in various parts of the cooling systems of the invention, one of skill in the art will appreciate that other specific temperatures may be used while still falling within the scope of the invention.

One of skill in the art will appreciate that the energy efficiency of the heating systems described is largely dependent on the temperature of the brackish water that is drawn from the production or supply well(s). For example, in the system shown in FIG. 3, the more heat energy that can be removed from the water in the chilled water loop by the first heat exchanger 362, the cooler the water will be when it enters the mechanical chiller 310 and the less energy that will have to be expended in operating the mechanical chiller 310. Thus, the energy efficiency and the need to use the backup evaporative cooling tower will depend on the temperature of the brackish water drawn into the system by the supply wells. Therefore, in some embodiments of the invention, a backup evaporative cooling tower is not included. Further, as the temperature of the brackish water from the supply wells varies, the temperature of the water in the brackish water loop as it exits from the first and second heat exchangers 362, 344 will vary accordingly. Similarly, the temperature of the water in the chilled water loop as it exits the first heat exchanger 362 and the temperature of the water in the condenser water loop as it exits the second heat exchanger 344 will also vary according to the temperature of the brackish water from the supply wells.

It will be appreciated that the manner in which ground temperature changes with depth is dependent on the geologic features of the ground in a particular area. Accordingly, in some areas the temperature may fall with increasing depth. Conversely, in other areas the temperature may increase with increasing depth. Finally, in some areas, the temperature may fluctuate with depth. For example, the temperature may first increase with depth and then start to decrease with additional depth. Embodiments of the system described herein can be designed to operate in any of these circumstances. For example, where the temperature of the ground decreases with depth, the return well would generally be at a depth that is shallower than the depth of the supply well. Conversely, where the temperature of the ground increases with depth, the return well would generally be at a depth that is deeper than the depth of the supply well.

Figure 4:
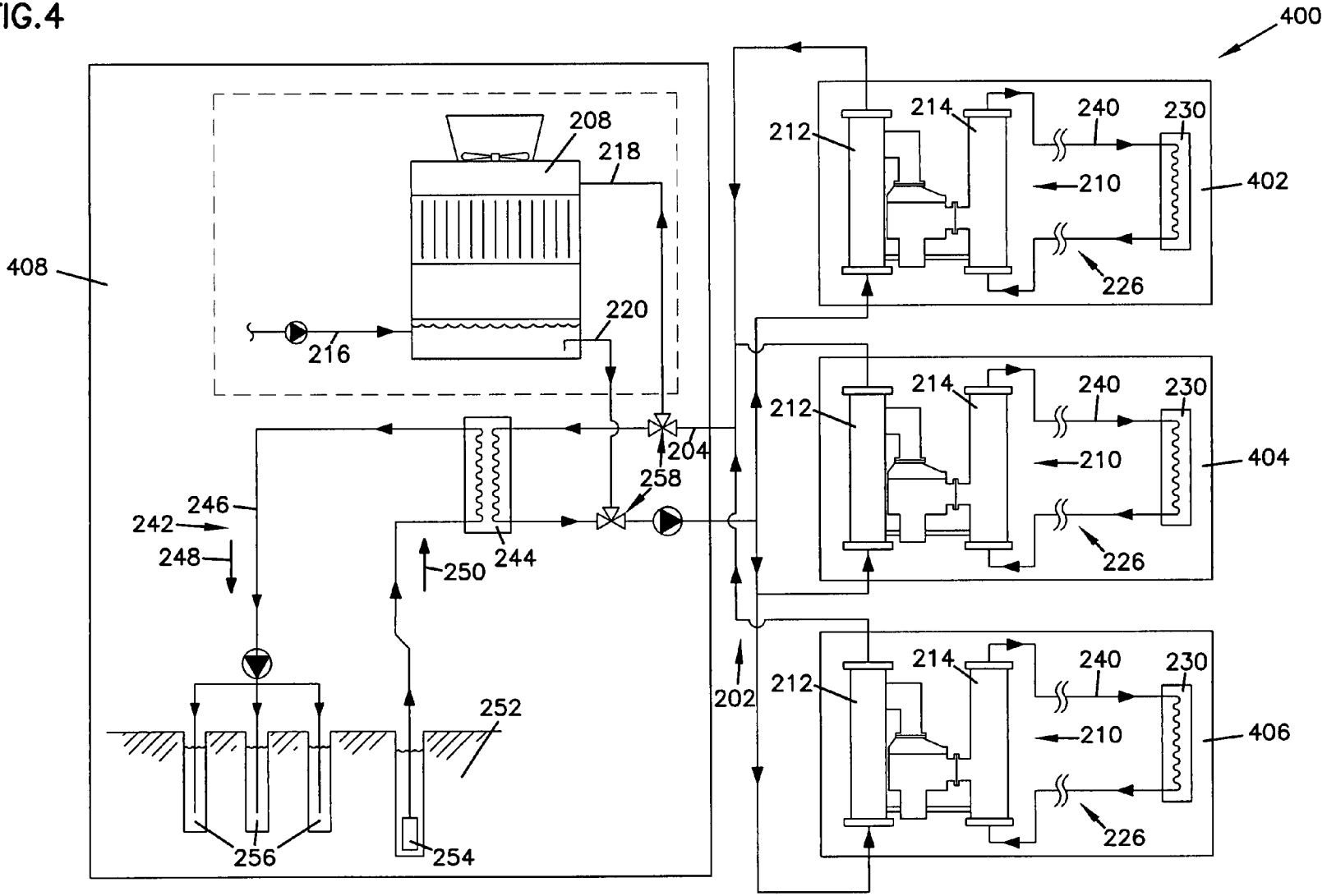
FIG. 4 is a schematic view of the system of FIG. 2 in a network configuration for serving multiple customers.

The brackish water based cooling systems described herein can be used to cool more than just a single commercially space. By way of example, the condenser water loop (202 or 302) can be routed underground to interconnect between a source location housing portions of the brackish water loop and customer locations housing mechanical chillers and the chilled water loop. Referring now to FIG. 4, a schematic view is shown of the system of FIG. 2 adapted to a network configuration serving multiple customers. As in FIG. 2, there is a brackish water loop 242 in thermal communication with a condenser water loop 202. In the system of FIG. 4, the condenser water loop is in thermal communication with a plurality of chiller water loops 226. The chiller water loops are at the site of customer locations 402, 404, and 406. The brackish water loop 242 and the optional cooling tower 208 are disposed at the source location 408. In this system, it is the condenser water loop 202 that spans the distance between the source location 408 and the customer locations 402, 404, and 406. The distance between the source location and the customer locations could be anywhere from less than a block to more than ten blocks. In an alternative embodiment, the chilled water loop could be configured to span the distance between the source location and the customer locations.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "adapted and configured" describes a system, apparatus, or other structure that is constructed or configured to perform a particular task or adopt a particular configuration to. The phrase "adapted and configured" can be used interchangeably with other similar phrases such as arranged and configured, constructed and arranged, adapted, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific and preferred embodiments and techniques. However, it should be understood that many variations and modifications may be made while remaining within the spirit and scope of the invention.

We claim:

1. A brackish water based cooling system, comprising:

a brackish water loop comprising a supply well adapted and configured to draw brackish water from the ground, a brackish water conduit adapted and configured to hold and transfer brackish water, in fluid communication with the supply well, and a return well adapted and configured to return brackish water to the ground to a first depth, wherein the ground at the first depth has a temperature that is within twenty-five degrees Fahrenheit of the temperature of the brackish water being returned, a condenser water loop in thermal communication with the brackish water loop, the condenser water loop comprising a condenser water conduit adapted and configured to hold and transfer a fluid, and a chilled water loop in thermal communication with the condenser water loop, the chilled water loop comprising a chilled water conduit adapted and configured to hold a fluid.

2. The brackish water based cooling system of claim 1, wherein the ground at the first depth has a temperature that is within fifteen degrees Fahrenheit of the temperature of the brackish water being returned.

3. The brackish water based cooling system of claim 1, wherein the ground at the first depth has a temperature that is within five degrees Fahrenheit of the temperature of the brackish water being returned.

4. The brackish water based cooling system of claim 1, further comprising a heat pump adapted and configured to transfer heat from the chilled water loop to the condenser water loop.

5. The brackish water based cooling system of claim 4, the heat pump comprising a mechanical chiller.

6. The brackish water based cooling system of claim 5, the mechanical chiller comprising an evaporator and a condenser.

7. The brackish water based cooling system of claim 1, the chilled water loop further comprising cooling coils adapted and configured to cool air in an enclosed space.

8. The brackish water based cooling system of claim 1, wherein the brackish water loop is in thermal communication with the chilled water loop.

9. The brackish water based cooling system of claim 1, the brackish water conduit comprising a corrosion resistant material.

10. The brackish water based cooling system of claim 1, comprising a plurality of chilled water loops all in thermal communication with the condenser water loop.

11. The brackish water based cooling system of claim 10, comprising a cooling network having a source location and a plurality of customer locations, wherein the condenser water loop provides thermal communication between the source location and the plurality of customer locations.

12. The brackish water based cooling system of claim 1, the brackish water loop comprising a plurality of supply wells.

13. The brackish water based cooling system of claim 1, the brackish water loop comprising a plurality of return wells.

14. The brackish water based cooling system of claim 1, the condenser water loop further comprising a cooling tower.

15. A method for providing cooling with brackish water comprising the steps of:

drawing brackish water of a first temperature from a supply well from a first depth, transferring heat to the brackish water increasing its temperature to a second temperature, and returning the brackish water through one or more return wells to a second depth, wherein the ground at the second depth has a temperature within about twenty-five degrees Fahrenheit of the second temperature.

16. The method of claim 15, wherein the ground at the second depth has a temperature within about fifteen degrees Fahrenheit of the second temperature.

17. The method of claim 15, wherein the ground at the second depth has a temperature within about five degrees Fahrenheit of the second temperature.

18. A brackish water based cooling system, comprising:

a brackish water loop comprising a supply well adapted and configured to draw brackish water from the ground from a first depth, the ground at the first depth having a first temperature, a brackish water conduit adapted and configured to hold and transfer brackish water, in fluid communication with the supply well, and a return well in fluid communication with the brackish water conduit, the return well adapted and configured to return brackish water to the ground to a second depth, the ground at the second depth having a second temperature, the returned brackish water having a third temperature, wherein the difference between the first temperature and the second temperature is at least 5 degrees Fahrenheit, wherein the difference between the second temperature and the third temperature is less than 25 degrees Fahrenheit, a condenser water loop in thermal communication with the brackish water loop, the condenser water loop comprising a condenser water conduit adapted and configured to hold and transfer a fluid, and a chilled water loop in thermal communication with the condenser water loop, the chilled water loop comprising a chilled water conduit adapted and configured to hold a fluid.

* * * * *